United States Patent [19]

Liberman

[11] Patent Number: 4,746,009

[45] Date of Patent: May 24, 1988

[54] CARRYING AND DISPLAY CASE

[75] Inventor: Harold N. Liberman, Monee, Ill.

[73] Assignee: Wholesale Electrical Distributors, Inc., Frankford, Ill.

[21] Appl. No.: 12,263

[22] Filed: Feb. 9, 1987

[51] Int. Cl.[4] ..... B65D 23/12

[52] U.S. Cl. ..... 206/44.11; 206/45.15; 206/328; 206/334; 190/16; 434/365

[58] Field of Search ..... 434/365; 206/45.11, 206/45.15, 334, 328, 331, 329, 44.11; 211/169; 190/16; 40/611

[56] References Cited

U.S. PATENT DOCUMENTS

| | | | |
|---|---|---|---|
| 2,773,589 | 12/1956 | Hennessey | 206/44.11 |
| 2,804,226 | 8/1957 | Freedman | 206/45.11 X |
| 3,554,429 | 1/1971 | Cohen | 206/334 X |
| 3,729,091 | 4/1973 | Davis | 206/44.11 |
| 3,858,726 | 1/1975 | Rosenwein | 206/45.15 X |
| 4,047,612 | 9/1977 | Lohmann | 206/328 X |
| 4,274,537 | 6/1981 | Cooper | 206/329 |
| 4,285,556 | 8/1981 | Loeffel | 211/169 X |
| 4,478,331 | 10/1984 | Roin | 206/328 X |

FOREIGN PATENT DOCUMENTS

| | | | |
|---|---|---|---|
| 1470582 | 4/1977 | United Kingdom | 190/16 |

*Primary Examiner*—Richard J. Apley
*Assistant Examiner*—Robert W. Bahr
*Attorney, Agent, or Firm*—Irwin C. Alter

[57] ABSTRACT

A carrying case for a display board that carries information and product samples. The case includes at least one pair of opposed, interior-facing slots for receiving a display board, and an open aperture to expose one face of the display board. Typically, the display board includes electrical components which may be removed from the carrying case and connects to a processor such as a microprocessor or a computer, for operating the electrical components in an integrated manner for display.

3 Claims, 2 Drawing Sheets

CARRYING AND DISPLAY CASE

BACKGROUND OF THE INVENTION

A major problem in the dissemination of complex information lies in the problem of getting the information together with the people who should receive it. Particularly in the field of sales, the objective of almost every salesman is to, in one way or the other, find the right time and location to cause his prospective customers to be willing to accept a presentation of the advantages of his given product. This problem is of course not only limited to salesmen, but exists in various aspects of technical education, military training, and the like.

In accordance with this invention, a method is provided which greatly facilitates the presentation of a variable format of complex information to a variable group of recipients, with greatly improved convenience on the part of the recipients which, as any salesman knows, makes the job of getting the presentation accomplished much easier. By this invention a high quality technical presentation may be made, which typically incorporates comfortable surroundings, plus sophisticated lighting and good visual/demonstration aids. Despite the fact that such may be provided in accordance with this invention, the typical disadvantages of such a high quality presentation may be avoided. Specifically, while a typical high quality presentation facility is generally immobile, such a high quality presentation of complex information may be brought to the recipients by this invention, so that they are not required to spend travel time. Additionally in accordance with this invention, the sophisticated, complex presentation possible by this invention can be quickly switched as to its format and contents in a manner which is not customary, when one is considering typical sophisticated presentations of complex information.

Thus, for example, a sales team can make presentations to two different customers in accordance with this invention, with each presentation taking place at the plants or offices of such customers and with a short time span between the two presentations. Nevertheless the subject matter of the two presentations can be entirely different, if desired. Despite these advantages of flexibility, convenience to the recipients, and speed of operation, the recipients can receive the presentation in a comfortable, sophisticated environment, which is a factor well-known by salesmen to be an effective tool for accomplishing their purposes.

DESCRIPTION OF THE INVENTION

In accordance with this invention, a method is provided of presenting information and product samples to recipients, which comprises moving to a site of display a mobile vehicle such as a trailer or truck, which carries a walled compartment of a size sufficient to accommodate a plurality of persons and to permit them to stand in and move around the compartment. Accordingly, this compartment may be set up rather in the manner of a classroom, and is naturally decorated and set up with chairs or the like and wall displays, as well as effective lighting.

One carries to the site of display in separate container means a plurality of display boards which carry the information and product samples. One removes the display boards from the separate container means, and attaches the plurality of display boards to carrying means positioned in the compartment. The attachment means may be attached to the wall or walls itself of the compartment, if desired.

Accordingly, by the method of this invention, an effective sales tool is provided to the salesman, although the invention of this invention is greatly advantageous in other fields as well as sales.

The mobile vehicle may be driven right into the parking lot of the customer. A resistant potential customer is far less likely to make excuses about being too busy when the display is standing right outside his front door. In the short time that it takes for the customer to walk from his office to the mobile vehicle, the user can remove the desired display boards from their carrying cases and mount them on the carrying means in the compartment. One may bring along a series of display boards, but mount and display only those precise display boards appropriate for a particular designated program and presentation, which program and presentation may be decided on by a quick discussion with the customer just before he walks from his office to the display compartment.

The display board may carry, for example, electrical components as an integral functioning part of the display, or as product samples, or both. These electrical components of the various boards on display may be connected to a processor, for example a personal computer or a microprocessor, so that the display boards may be operated together in an integrated manner for display.

After the customer has received the sophisticated presentation in comfortable surroundings, he simply may walk back to his office. It then is a matter of only a very few minutes to break down the display by return of the display boards to their container means, following which the mobile vehicle may be moved from the site of display. If desired, the vehicle may then travel to a new location, perhaps only a short distance away, where the entire process can be repeated. Depending upon what presentation is desired, the appropriate display boards are selected from the collection, withdrawn from their containers, and quickly and easily mounted in the compartment.

If desired, electrical components on the boards may be connected to a personal computer, which is simply programmed with a new program to operate in appropriate manner the new selection of display boards, to provide to the new customer a completely different program of display of information and product samples.

Accordingly, a major increase in both the efficiency and effectiveness of sales programs may be provided by the method of this invention. More customers may be reached under circumstances in which the customers will tend to be more willing to attend the presentation. At the same time, the presentation may be a fully sophisticated program with all desired electronic and visual aids, substituting for a makeshift sales presentation out of a briefcase, which until now has been the only way to reach a busy executive who has no time to leave his office and attend a sophisticated, formal sales presentation with visual aids in someone else's sales office or a hotel.

Additionally, a novel carrying case is provided for carrying the display boards used herein. The carrying case comprises a body having a hollow interior, the body defining at least one pair of opposed, interior-facing slots for slideably receiving opposed ridges of a display board. The body defines an open aperture to expose one face of the display board carried therein. This faciliates identification of the board, and also spot checking of its components, particularly electrical components, to be sure there is no embarrassing failure during the presentation. At the same time, the display board can be well protected since it is recessed within the carrying case, which may be of rigid material such as wood.

The carrying case may have a hinged lid rotatable between positions opening and closing one end of the opposed slots, for permitting sliding of a display board in and out of the carrying case when open and for protecting the board when closed. Latch means may be provided for locking the hinged lid in closed position.

A plurality of spaced pairs of closed slots made present for receiving a plurality of display boards, if desired. The various spaced pairs of slots may be of variable length or other dimension, if desired, for receiving display boards of differing sizes.

DESCRIPTION OF SPECIFIC EMBODIMENTS

Figure 1:
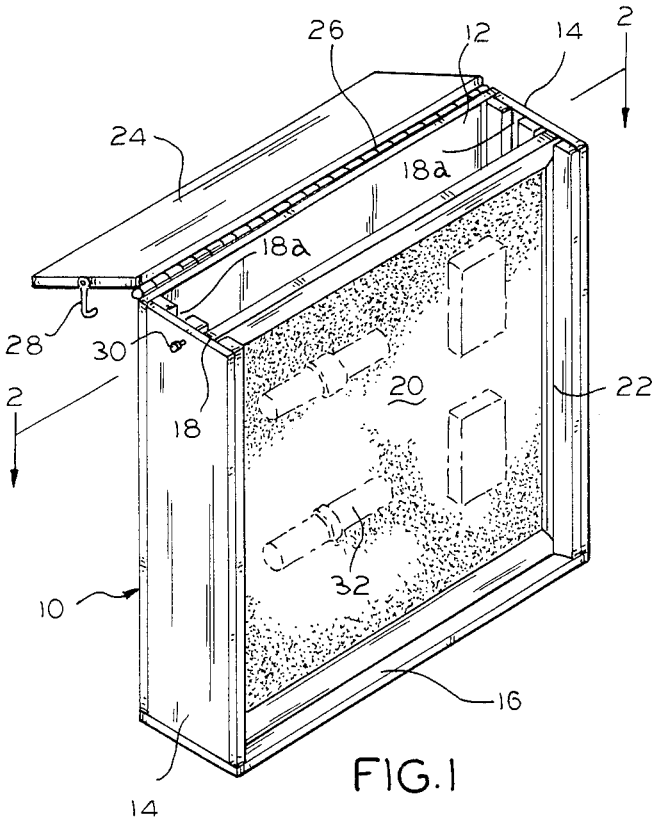
FIG. 1 is a perspective view of the carrying case of this invention, carrying a display board.
Figure 2:
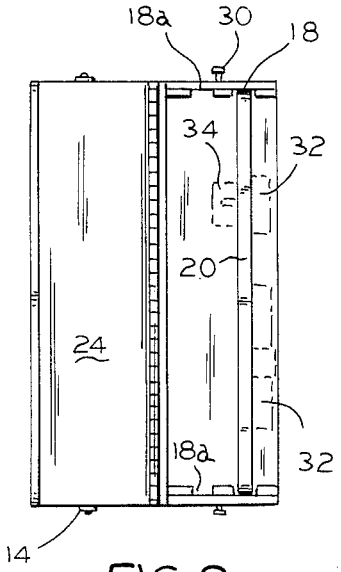
FIG. 2 is a view of the carrying case of FIG. 1 taken along line 2—2 of FIG. 1.
Figure 3:
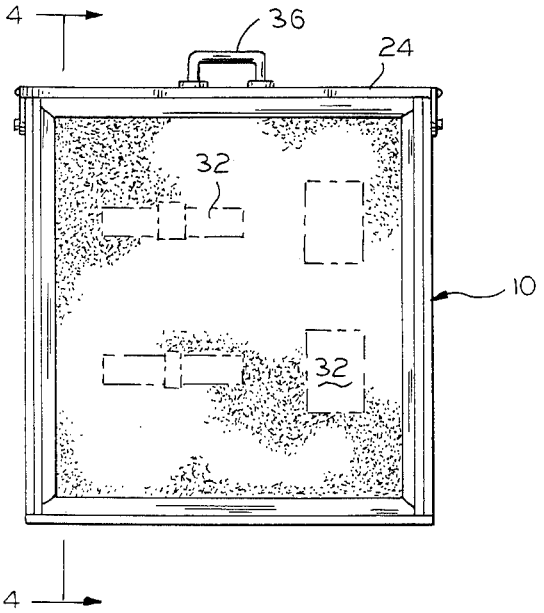
FIG. 3 is an elevational view of the carrying case of FIG. 1, with the hinged lid in closed position.
Figure 4:
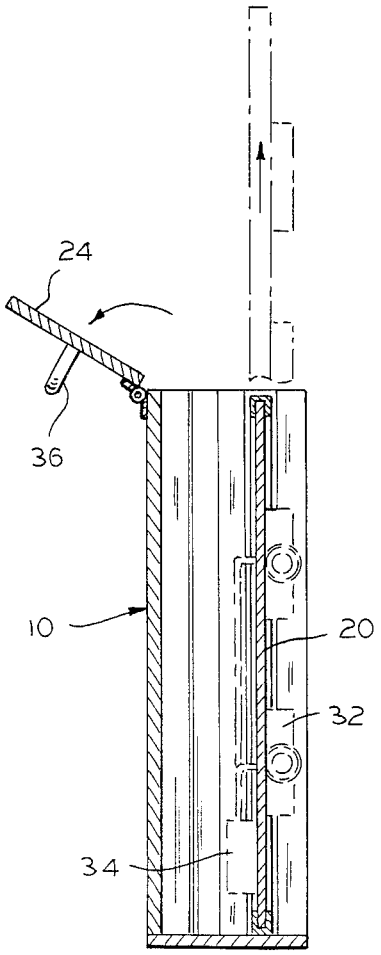
FIG. 4 is an elevational view taken along line 4—4 of FIG. 3.

Referring to FIGS. 1 through 6, carrying case 10 as disclosed comprising a body made of wood, metal or typically rigid plastic, and defining rear wall 12, opposed side walls 14, and bottom wall 16. Carrying case 10 also includes two pairs of opposed, interior-facing slots 18, 18*a* which are proportioned to receive the opposed edges of a display board 20. Specifically, slots 18 are shown to be in such receiving relation with the vertical edges of display board 20.

In accordance with this invention, an aperture 22 is provided to expose one face of display board 20 to the exterior, as specifically shown in FIG. 1. Specifically, aperture 22 is shown to be of substantially the dimension of the hollow interior of the carrying case 10, so that the entire board 20 may be viewed, tested, and inspected without removal from case 10, but the board is still protected by being in recessed relation in the carrying case.

Additionally, lid 24 is attached by hinges 26 to the upper edge of back wall 12, to be rotatable between positions opening and closing one end of each of opposed slots 18, 18*a*. Likewise, latch hook 28 is provided to engage boss 30 to hold hinged lid in the closed position, with another corresponding latch hook and boss being provided at the opposite side of carrying case 10.

It can be seen that the particular display board 20 carried within case 10, in turn, carries outwardly projecting electrical components 32, 34 extending outwardly from both sides thereof. The slot pairs 18, 18*a* may be positioned so that the board and samples do not touch the carrying case except at the periphery of the board, as shown. Also, slot pair 18*a* may be of a lesser depth than slots 18, to accommodate a corresponding display board of less height, if desired.

Handle 36 is also provided on lid 24.

Figure 5:
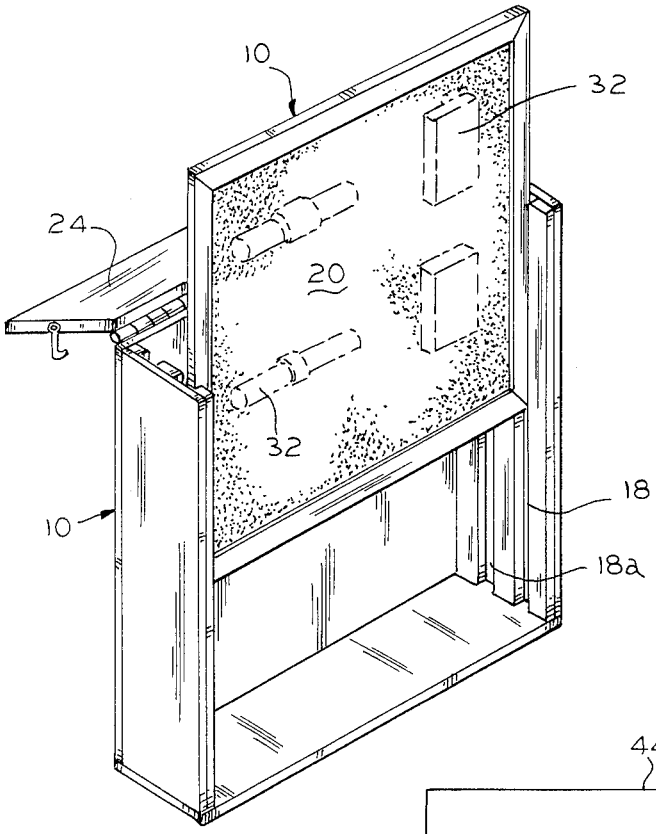
FIG. 5 is a perspective view of the carrying case of FIG. 1, showing the display board in partially removed configuration.
Figure 6:
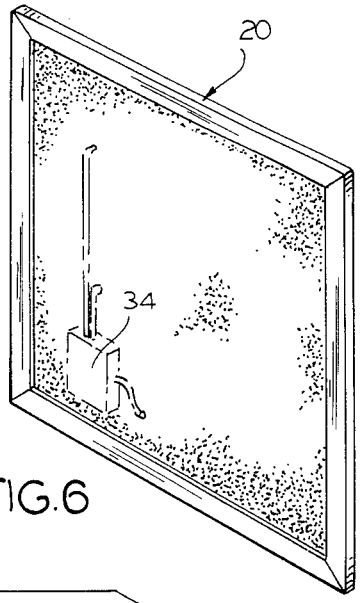
FIG. 6 is an elevational view of the rear side of the display board shown in FIG. 5.

FIG. 5 shows how a display board 20 may be inserted or removed by sliding into one of the pairs of slots 18 or 18*a*, with lid 24 being in the open position. FIG. 6 shows a circuit board 20, and its rear side carrying projecting electrical component 34. The electrical components 32 and 34 which are carried on boards 20 may be on display themselves for purposes of sales or education, or they may be components that work as an integral part of the display for providing desired light, sounds, images or the like. For example, one or more of display boards 20 may carry different types of electrical components such as programmable controls, timers, photoelectric controls, counters, drives, or proximity sensing equipment. These devices may be carried on various boards 20, along with illustrations, lettering, or LED or liquid crystal displays operated by a computer program so that a demonstration or sales display may be provided by the boards 20 which are present on display, with the electrical components being optionally operated in a demonstration mode.

Figure 7:
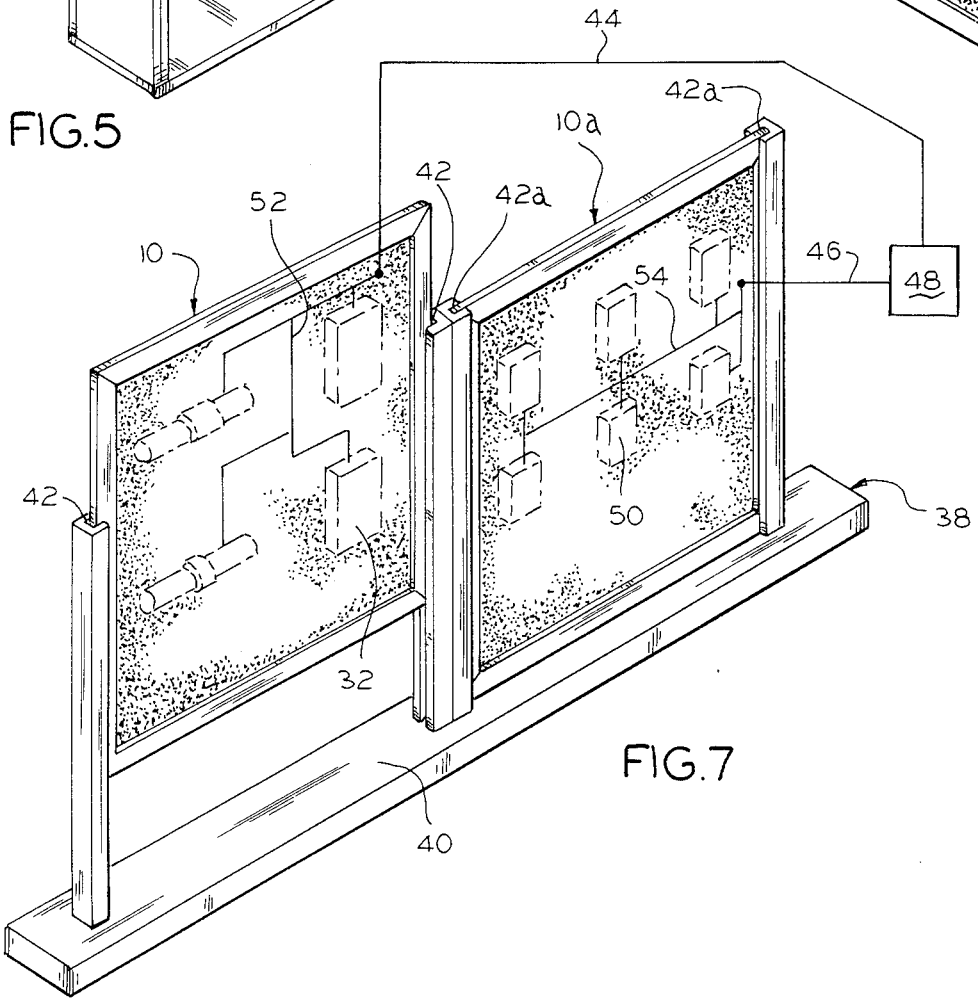
FIG. 7 is an elevational view of carrying means, postioned within the walled compartment of a mobile vehicle, shown to be carrying a pair of display boards removed from one or more carrying cases in accordance with FIG. 1 and installed in the carrying means, for display and demonstration of electrical components carried thereon, with a portion of the view shown schematically.

Referring to FIG. 7, display board 10 and a companion display board 10*a* may be removed from their respective carrying cases in accordance with this invention, and placed in carrying means 38 for display. Carrying means 38 as specifically shown includes a base 40 and a plurality of U-shaped, opposed channel members 42, 42*a* for receiving peripherial edges of display boards 10, 10*a*. Thus, the boards 10, 10*a* may be selected as desired from a collection of display boards for the specific, selected demonstration which is to take place. After installation, boards 10, 10*a* may be electrically connected by wires 44, 46 to a personal computer 48 which has been "booted up" with a desired demonstration program. Accordingly, the electrical components 32, 34 of display board 10, and other electrical components 50 of display board 10*a*, may be connected together in an integrated manner for display as operated by computer 48 and/or by other controls which are directly controllable by the lecturer.

Wires 44, 46, may be connected by any conventional temporary, quick connection means to permanent wires 52, 54 mounted respectively on boards 10, 10*a*, for electrical connection of those components 32, 34, 50 as may be desired.

It is understood that the electrical components 32, 34 and 50 may also be electronic components including microprocessors so that the program of operation of each display board may be carried by the display boards themselves, if so desired. Likewise, the display boards may carry voice recorders and other pictorial and graphic aids such as light indicators and the like to demonstrate the operation of other electrical components carried on the board or boards and to point out the advantages thereof.

Alternatively, the carrying means used for attaching display boards 10, 10*a* in position within the compartment of the mobile vehicle may include channel racks running perferably, substantially the entire width of one or more of the walls of the compartment. The channel racks may have a series of holes to receive bolts or screws extending through predrilled holes of the display boards, so that the display boards may be attached to the wall of the compartment in any of a large variety of configurations for purposes of the demonstration and display.

At the end of the program of demonstration and display, the display boards 10, 10*a* may be removed from carrying means 40, disconnecting wires 44 and 46, and reinstalled in their respective carrying cases 10. The mobile vehicle may move on to its next stop, and, if desired, different display boards may be removed from their carrying cases and installed into carrying means 40 for an entirely different program at the next stop.

The invention of this application can be used, for example, to compare the performance characteristics of lighting fixtures in pairs, so a customer can compare the light from several fixtures at once. For example beam patterns of track lighting fixtures can be projected on varying backgrounds for comparisons of lamps and lighting fixtures, so that the entire compartment turns into a "life-sized light box", referring to the small teaching tool presently used in showrooms to display and compare the light from various fluorescent lighting fixtures.

The above has been offered for illustrative purposes only, and is not intended to limit the scope of the invention of this application, which is as defined in the claims below.

That which is claimed is:

1. A carrying case for a display board that carries information and product samples, said carrying case comprising a body having a hollow interior, said body defining at least one pair of opposed, interior-facing slots for slideably receiving opposed edges of a display board, said body defining an open aperture generally parallel to said slots and free of closure means to expose one face of a display board carried therein, a hinged lid rotatable between positions opening and closing one end of said opposed slots, and latch means for locking said hinged lid in in closed position, said carrying case containing at least one display board having edges retained by said one pair of opposed slots, said display board carrying outwardly projecting electrical components, said slots being positioned so that said board and samples do not touch the carrying case except at the periphery of said board.

2. The carrying case of claim 1 in which a plurality of spaced pairs of opposed slots are present for receiviong a plurality of display boards.

3. The carrying case of claim 2 in which said open aperture is of substantially the dimension of said hollow interior.

* * * * *